US007137539B2

(12) United States Patent
Jackson

(10) Patent No.: US 7,137,539 B2
(45) Date of Patent: Nov. 21, 2006

(54) METHOD AND APPARATUS FOR SLITTING AND PROCESSING A WEB INTO PLURAL USE SUPPLY FORMS

(75) Inventor: Byron M. Jackson, Forest Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/126,029

(22) Filed: Apr. 19, 2002

(65) Prior Publication Data

US 2002/0113108 A1 Aug. 22, 2002

Related U.S. Application Data

(62) Division of application No. 09/133,570, filed on Aug. 13, 1998, now Pat. No. 6,394,330.

(51) Int. Cl.
*B26F 3/00* (2006.01)
*B26D 1/12* (2006.01)

(52) U.S. Cl. ..... 225/2; 83/27; 83/404; 83/407; 83/676; 83/678; 225/96; 225/103

(58) Field of Classification Search ..... 225/96, 225/2, 96.5, 103, 93; 83/149, 27, 33, 407, 83/678, 862, 861, 879–887, 870, 404, 667, 83/676, 668, 103, 25, 39, 41
See application file for complete search history.

(56) References Cited

U.S. PATENT DOCUMENTS 870,024 A * 11/1907 Edison ..... 242/524
1,340,225 A * 5/1920 Howard ..... 225/2
1,465,967 A 8/1923 Cameron et al.
1,834,004 A 12/1931 Overbury et al.
2,053,786 A 9/1936 Straubel
2,710,060 A * 6/1955 Birkmann ..... 83/649
2,747,664 A 5/1956 Corson
2,897,893 A 8/1959 Rockstrom et al.
3,258,380 A * 6/1966 Fischer et al. ..... 156/207

(Continued)

OTHER PUBLICATIONS

"www.Thesaurus.com", www.thesaurus.com/break, Dec. 19, 2003.*

*Primary Examiner*—Kenneth E. Peterson
*Assistant Examiner*—Isaac N. Hamilton
(74) *Attorney, Agent, or Firm*—William J. Bond

(57) ABSTRACT

An apparatus and method of converting a web of indefinite length into a plurality of web portions by slitting the web at a transverse point prior to processing the web portions into a plurality of use supply forms (such as rolls), wherein the plurality of web portions are separated by a two-stage process. A first stage of the process is a partial separation operation that almost entirely separates the web portions, but leaves the web portions connected, such as by a slitting operation that leaves a series of connected zones. The second stage includes the complete separation, such as by breaking of the connected zones. The complete separation of the web portions preferably occurs near the station at which the use supply forms are created, such as a winding station. Thus, the web portions, after substantial separation at the first stage can be handled (for example, guided and tensioned) as if the plurality of web portions were a full width web. But, after handling and transporting of the web portions to the use supply form station, the web portions are completely split so that the plural web portions can be wound or otherwise converted into a plurality of use supply forms.

17 Claims, 4 Drawing Sheets

U.S. PATENT DOCUMENTS 3,456,855 A * 7/1969 Mutter ..... 225/96
3,490,503 A 1/1970 Hill et al.
3,540,638 A * 11/1970 Hamilton ..... 225/96
3,564,707 A * 2/1971 Ensign ..... 29/605
3,587,374 A 6/1971 Stewart
3,596,816 A * 8/1971 Brown ..... 225/2
3,695,131 A 10/1972 Zimmermann
3,808,919 A 5/1974 Pryce et al.
3,865,673 A 2/1975 DeTorre
3,958,051 A * 5/1976 Smith ..... 428/42.3
3,966,524 A 6/1976 Lehmacher
3,978,753 A * 9/1976 Meaden et al. ..... 83/678
4,072,076 A * 2/1978 Miles ..... 83/300
4,171,080 A 10/1979 Rogers
4,177,730 A 12/1979 Schriber et al.
4,370,910 A 2/1983 Suzuki et al.
4,484,500 A * 11/1984 Reba et al. ..... 83/98
4,580,336 A 4/1986 Kerley et al.
4,612,006 A * 9/1986 Tokuno et al. ..... 493/342
4,854,203 A * 8/1989 Wever ..... 83/321
4,932,932 A 6/1990 Schmidt et al.
5,100,040 A 3/1992 Kunreuther et al.
5,144,891 A 9/1992 McKenna
5,259,543 A 11/1993 Downing
5,290,226 A 3/1994 Green, Jr.
5,842,664 A 12/1998 Akerlund

* cited by examiner

METHOD AND APPARATUS FOR SLITTING AND PROCESSING A WEB INTO PLURAL USE SUPPLY FORMS

CROSS-REFERENCE TO RELATED APPLICATIONS

This application is a division of U.S. Ser. No. 09/133,570, filed Aug. 13, 1998 issued as U.S. Pat. No. 6,394,330 on May 28, 2002.

TECHNICAL FIELD

The present invention generally relates to web processing apparatus and methods for slitting a wide web of material into plural web portions and subsequently winding the web portions into separate rolls. In particular, the web material is initially slit while leaving connections between the web portions and breaking the connections prior to winding.

BACKGROUND OF THE INVENTION

In some situations, it is desirable to split a single, relatively wide web of material into a plurality of relatively narrow web portions and wind the web portions into several rolls (or otherwise convert the web portions into use supply forms). It is generally more efficient to produce and/or process material in wider webs but often more convenient to package, ship, sell, and/or use the material in narrower rolls. Also, the narrower web portions are preferred or required for some applications. Common examples of web materials that are often split into web portions include paper (for example, toilet paper, computer paper, paper towels, etc.) and tape (for example, adhesive tape, magnetic tape, etc.). Slitting can be done on single webs (for example, films), structured webs (for example, webs with structured features), multilayer laminates, or coated webs (for example, adhesive coated webs for making adhesive tape).

A plurality of web portions can be formed from a web by slitting (or otherwise cutting) the web in the lengthwise direction so that the individual web portions are separated from one another. U.S. Pat. No. 3,695,131 issued to Zimmermann relates to one such approach wherein a web is carried by a traveling support surface across razor sharp cutting edges of circular slitting blades, wherein the web is held on the traveling support to reduce longitudinal or transverse shifting of the web portions. The slitter blades are rotated so as to distribute wear uniformly about the circumferences of the slitter blades. After slitting, the various web portions are directionally separated by directing adjacent web portions through different guide means that thread the web portions to different winding reels.

U.S. Pat. No. 2,897,893 issued to Rockstrom et al. relates to another slitting mechanism in which a continuous web of material is taken from a mill roll and passed over a compensating roll in a rewind machine and under a cutter roll against which the web is slit into web portions before winding into a rewind roll. Slitting wheels bear against a hardened sleeve of the cutter roll at any desired position along the sleeve and they bear with sufficient pressure to sever the web into web portions. The slitting wheels are softer than the hardened sleeve and, although preferably not given a sharp edge, they divide the web. Immediately after the web is cut by the slitting wheels, an angular-faced spreader having a vertical, forward-extending center with backswept sides bears against the web with the forward center of the spreader bearing on the line of the cut to push the web portions apart and to assure their complete separation along the cutting line. U.S. Pat. No. 1,465,967 issued to Cameron et al. relates to a somewhat similar slitting and rewinding machine that also includes a secondary separating device having a knife blade for severing any stray fibers connecting adjacent web portions that have not been severed by the slitting action. The secondary separating device severs the stray fibers after slitting and before winding of the web portions.

After the plural web portions are split and separated, they typically pass individually through guiding and tensioning rollers and then are ultimately wound about a core to form a roll of web material. Each web portion may be individually guided to a distinct core, or plural cores can be supported in axial alignment on a single shaft. Often, adjacent web portions are divided to different winding shafts supporting such plural cores so that they can be guided without interfering with one another. Alternatively, the plural web portions can ultimately be folded, cut, or otherwise processed to form a stack (or other form) of web material. The roll or stack of web material is the use supply form that is used by the consumer of the web portions. To process the split, separated web portions to create use supply forms, each web portion must be individually guided, which requires accurate control to prevent each web portion from wandering. Tension control is an important aspect of web guiding, and web properties (such as the thickness of the web across the web) can cause slight variations in guiding and tensioning each web portion. Variations in guiding and tensioning can cause the web portions to wander and be wound with uneven edges and, where several rolls are wound side by side about a common winding shaft, to be wound with overlapping and interweaved edges that cause the several rolls to become intermeshed.

It is also known to perforate web or web portions prior to forming the use supply forms in order to provide a perforation or tear line so that someone or something provided with the web material in use supply form can split the web material by tearing along the perforations. The perforation or tear line is formed by cutting a plurality of small, spaced slits in the web material. The connections of the web material that remain between the slits maintain the structural integrity of the web material until the connections are torn to further separate the web or web portion along the perforation line. A number of different configurations of perforations lines have been developed.

Perforations can be created in the machine direction of a web or web portion by a perforating wheel having a beveled cutting edge in which one or more notches are formed at angularly spaced intervals so as to define cutting and non-cutting portions of the cutting edge. Typically, several perforating wheels are spaced and rotatably mounted along a bar so that the perforating wheels tangentially contact the outer surface of a back-pressure roll, which is rotated by a motor or the like. The rotation of the back-pressure roll causes the perforating wheels to rotate. The web is run between the perforating wheel and the back-pressure roll and, as the perforating wheels rotate and the cutting portions of the cutting edges come into contact with the web, the cutting portions of the cutting edges penetrate and cut the web to form the perforations. When the perforating wheels further rotate and the non-cutting portions move over the web, the notches formed in the cutting edges prevent the web from being cut, which forms the connections in the perforation line. A perforating wheel of this general type is disclosed in U.S. Pat. No. 3,978,753 issued to Meaden et al. Thus, perforations can be provided in the longitudinal direction so as to define two or more connected web subportions that are wound or stacked into the use supply form.

Perforations can be provided across the transverse width of the web or web portion so as to define individual sheets of the web material. Examples include paper towels and toilet paper, which are typically perforated so that individual sheets can be separated from the roll by the consumer. Many techniques have been developed to make transverse perforation as a web is moved in a machine direction. Most rely on a perforating roll that creates the perforation lines at spaced intervals on the web based upon a notched cutting edge extended transversely on the roll. Whether longitudinally or transversely perforated, such connected web subportions are designed to be separated by a consumer as the web material is converted from its use supply form.

One noteworthy application of perforations in web or web strands is in continuous paper of the type commonly used in computer printers, especially contact or dot matrix type computer printers. Continuous paper of this type is commonly sold as a stack or roll of paper having rows of perforations across the width of the paper. The spacing of the these rows determines the length of the page. Typically, the paper is folded along the perforations alternately in opposite directions, resembling a fan or accordion. Such continuous paper can be moved past a printer mechanism of a printer using a friction feed mechanism that pinches the paper between two rollers, one of which is typically driven by a motor. However, when more than a few pages are printed using only a friction feed mechanism, the continuous paper tends to wander out of alignment.

One solution to the wandering problem adapted for contact or dot matrix type computer printers involves the use of a tractor feed mechanism in which sprockets engage holes in special computer paper. The computer paper is continuous as described above but also has a narrow guide strip on each side along the length of the paper. The guide strips have a plurality of regularly spaced holes for engaging the sprockets in the tractor feed mechanism to advance the paper. Each guide strip is typically separated from the sheet by perforations that define tear lines.

Although the pages of a printout (the printout being computer paper on Which the printer has printed) are sometimes left joined together end to end, the guide strips on the sides are usually removed. Because removing the guide strips after the paper has exited the printer can be time consuming (for example, if the guide strips are removed page by page) and/or can damage the paper (for example, if the guide strips are removed from several sheets of folded paper at once), several approaches to separating the guide strips from the paper immediately after printing but before the paper exits the printer have been developed. For example, U.S. Pat. No. 5,259,543 issued to Downing relates to a parting tool that can be attached to a tractor feed mechanism for separating the guide strips from computer paper as the paper passes through the tractor feed mechanism. The parting tool includes a blade intersecting the plane of the paper for shearing the paper along the perforations connecting the guide strips to the sheets of paper.

The continuous and computer papers described above are provided to the consumer in use supply form with perforations provided in the web material in its use supply form. Separation of the perforations occurs, if ever, at or after use by the consumer. In other words, the perforations are not separated in the process of making the use supply form.

SUMMARY OF THE INVENTION

The present invention relates to an apparatus and method of converting a web of indefinite length into a plurality of web portions by slitting the web at at least one transverse point prior to processing the web portions into a plurality of use supply forms (such as rolls), wherein the plurality of web portions are separated by a two-stage process. Preferably, the converting process is continuous in a machine direction of travel by the web. A first stage of the process is a partial separation operation that almost entirely separates the web portions, but leaves the web portions connected, such as by a slitting operation that leaves a series of connected zones. The second stage includes the complete separation, such as by breaking of the connected zones. The complete separation of the web portions preferably occurs near the station at which the use supply forms are created, such as a winding station. Thus, the web portions, after substantial separation at the first stage can be handled (for example, guided and tensioned) as if the plurality of web portions were a full width web. But, after handling and transporting of the web portions to the use supply form station, the web portions are completely split so that the plural web portions can be wound or otherwise converted into a plurality of use supply forms. By handling and transporting the plurality of substantially split web portions as a full width web, the handling and transporting of each of the web portions separately and the possible resulting variations in guiding and tensioning that can lead to wandering and other problems can be avoided.

One aspect of the present invention is a method of converting a web having a transverse width and of indefinite length into plural use supply forms as the web is moved in a machine direction by slitting the web into plural web portions of indefinite length. The method comprises supplying a web having a transverse width and of indefinite length and transporting the web in a machine direction. The method also includes moving the web through a first separation stage and thereby partially separating the web at a point along its transverse direction for making a partially separated web and defining connected web portions running in the machine direction of the partially separated web. In addition, the method includes transporting the partially separated web from the first separation stage to and through a second separation stage and thereby separating the connected web portions into discrete web portions, and converting the discrete web portions into use supply forms thereof.

Another aspect of the present invention is an apparatus for converting a web having a transverse width and of indefinite length into plural supply use forms by moving the web in a machine direction and slitting the web into plural web portions of indefinite length. The apparatus comprises a source of a web having a transverse width and of indefinite length and transport means for moving the web from said source in a machine direction. The apparatus also includes a first separation stage located downstream from the source and comprising a first separation device that partially separates the web at a point along its transverse direction and makes a partially separated web having defined connected web portions that extend in the machine direction of the partially separated web. In addition, the apparatus includes a second separation stage located downstream from the first separation stage and comprising a second separation device that separates the connected web portions into discrete web portions, and a use form conversion station for converting the discrete web portions into use supply forms.

DETAILED DESCRIPTION OF THE INVENTION

Figure 1:
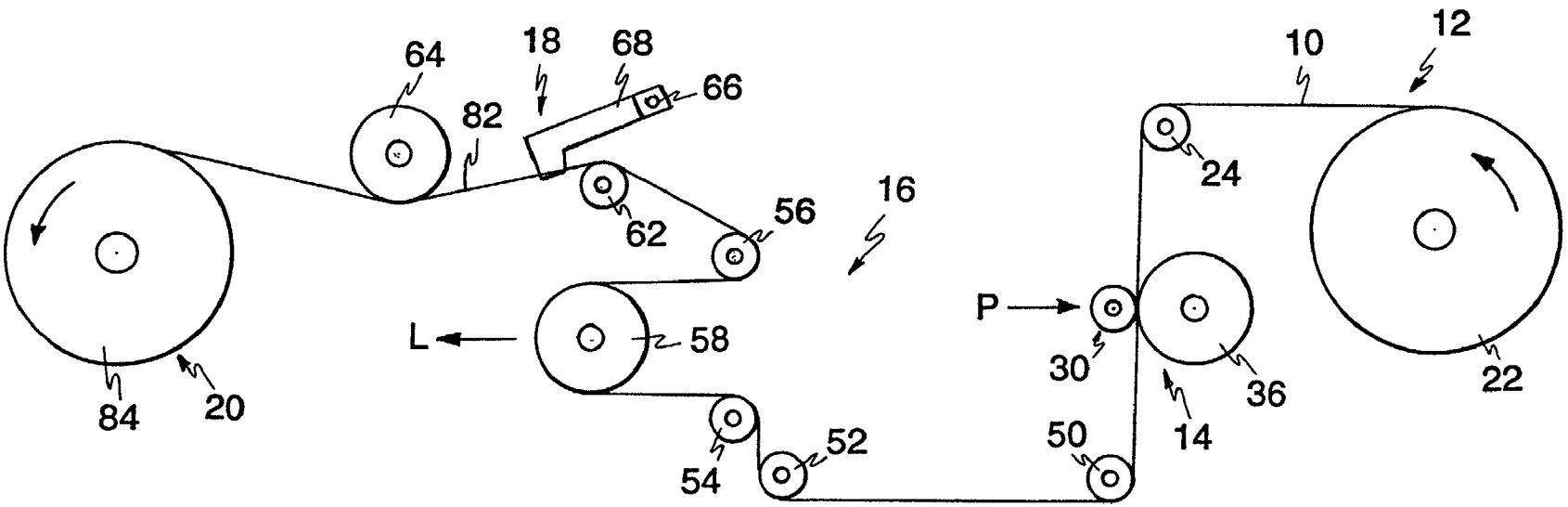
FIG. 1 is a schematic illustration of an apparatus for slitting and converting a web having an indefinite length into plural roll use supply forms.

An apparatus and method of slitting and winding a web according to the present invention is schematically illustrated in FIG. 1, wherein an elongate web 10 of indefinite length is supplied from a supply station 12, moved through a first stage separation mechanism 14, transported to and through a second stage separation mechanism 18 by way of a guiding and transporting system 16, and converted at a use supply form conversion station 20. In the illustrated version, the supply station 12 comprises a large roll 22 of web material from which the web 10 is unwound. Any conventional or developed manner of supporting the roll 22 of web material for unwinding is contemplated for use in accordance with the present invention. Web 10 from the supply station 12 is guided to the first stage separation mechanism 14, such as by a conventionally supported guide roller 24. The first stage separation mechanism 14, which will be described in greater detail below, operates to substantially, but not completely, divide web 10 at one or more predetermined transverse points into a partially separated web having a plurality of defined but connected web portions 26 (shown in FIGS. 2–3). The first stage separation mechanism 14 can include a wide variety of separating devices, some examples of which will be discussed and suggested below.

Figure 2:
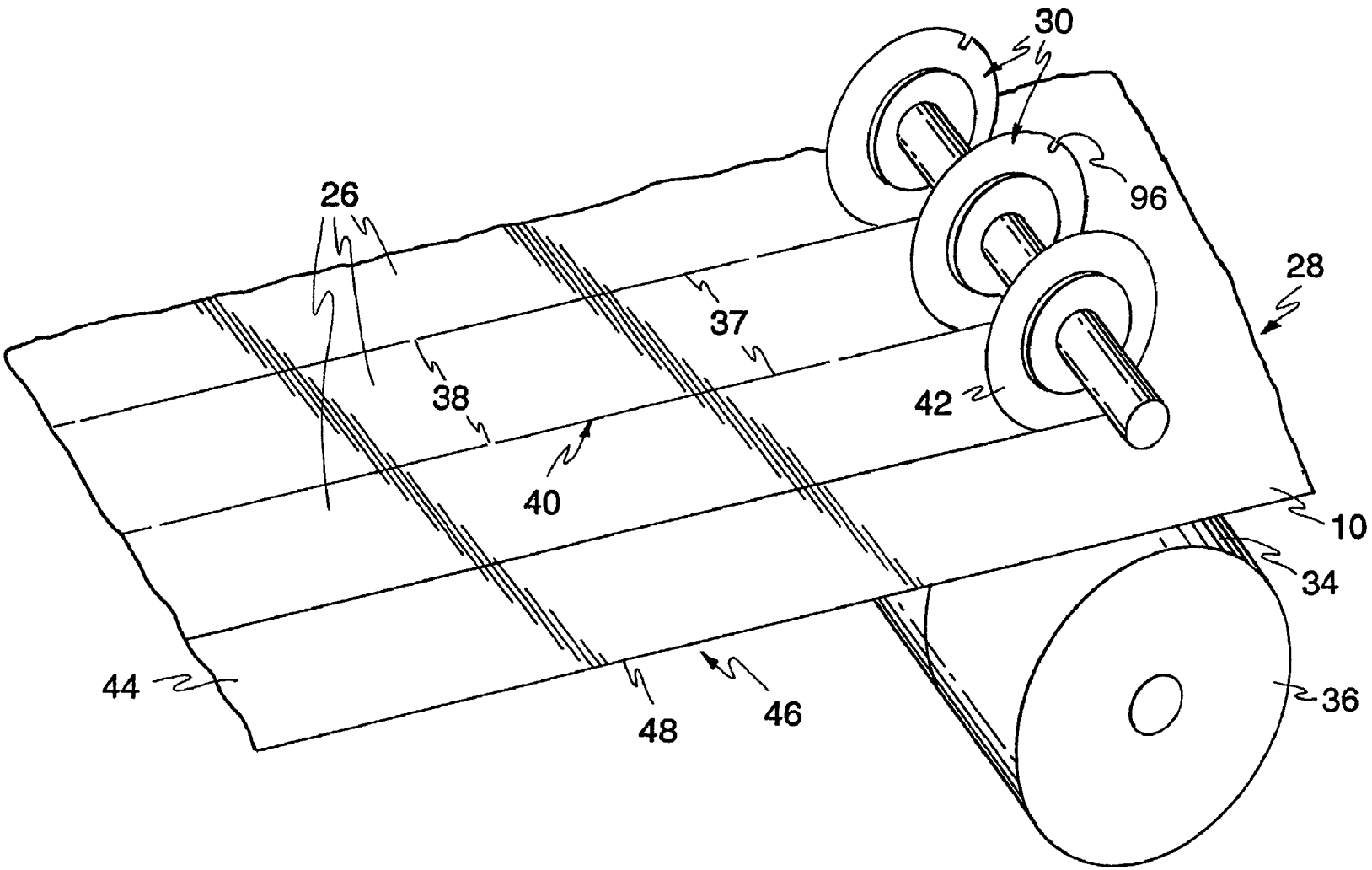
FIG. 2 is a perspective view of a plurality of slitting wheels positioned at transverse points across a web moving in a machine direction that substantially divide a web into web portions by spaced slits while leaving connected zones at predetermined intervals usable as a slitting mechanism for the apparatus of FIG. 1.

As shown in FIG. 2, a specific embodiment of a first stage separation mechanism 14 in the form of a slitting mechanism 28 comprises a plurality of slitting wheels 30 positioned at transverse points across web 10. The slitting wheels 30 are rotatably mounted axially about a shaft 32 so that the slitting wheels 30 tangentially contact an outer surface 34 of a back-pressure roll 36. Control pressure is preferably selectively applicable to the slitting wheels 30 individually to control the effectiveness of each slitting process as shown at P in FIG. 1. Control pressure can be applied by a pneumatic control system, for example, (not shown) or otherwise. The control system itself is not otherwise of relevance to the present invention and is not described or illustrated in greater detail herein. The provision of and supporting of cutting wheels at spaced transverse points along a machine direction of a web and the use of pneumatic control systems are well known in commercial machines for slitting a web into discrete portions. An example of such known machines are available from New Era Converting Machinery, Inc. of Hawthorne, N.J. Thus, the slitting wheels 30 can be conventionally or otherwise supported relative to a back-pressure roll 36.

The web 10 passes between the slitting wheels 30 and the outer surface 34 of the back-pressure roll 36. The slitting wheels 30 rotate freely about the shaft 32 in response to rotation of the back-pressure roll 36, which is typically driven in a conventional manner. As web 10 passes between the slitting wheels 30 and the back-pressure roll 36, web 10 is partially separated by the slitting wheels 30, which substantially cut web 10 into connected web portions 26 by forming (for example, by cutting a series of spaced slits 37) separation lines 40 (also generally referred to herein as lines of weakening) extending in the machine direction of web 10. Although the web portions 26 are defined and substantially cut, the web portions 26 are still connected to one another by connections 38 formed in the separation lines 40. Because the substantially cut web portions 26 are connected, a partially separated web is made where the defined web portions 26 act together as a full width web for purposes of handling and transporting.

The slitting mechanism 28 shown in FIG. 2 also can include one or more cutting wheels 42 rotatably mounted on the shaft 32 for completely cutting web 10 when web 10 passes through the slitting mechanism 28. The cutting wheels 42 may be used to cut one or more strips 44 from the lateral sides 46 of web 10. For example, often it is desirable to remove a portion of web 10 adjacent the lateral sides 46 of web 10 because the edges 48 of the lateral sides 46 may not be clean or uniform or because the spacing of the web portions 26 within web 10 is such that a portion of web 10 is waste. A strip 44 can, for example, be cut from a lateral side 46 of web 10 by the cutting wheels 42 so that the laterally outermost web portions 26 are properly sized and have clean, uniform outer edges. Preferably, the strips 44 are cut and separated from the web 10 at the same time that the connected web portions 26 are substantially cut from web 10 by the first stage separation mechanism 14 but may be otherwise cut before or after the separation lines 40 are formed. Also, the strips 44 can be defined in web 10 by forming outer separation lines (not shown) and severing the connections of the outer separation lines at the same time (or before or after) and in the same manner as the connections 38 that connect the web portions 26 to one another.

After substantially cutting web 10 to make the partially separated web with defined connected web portions 26, the connected web portions 26 are physically transported to the use form conversion station 20 by the guiding and transporting system 16 shown in FIG. 1. Because the web portions 26 can be handled as a full width web, the guiding and transporting system 16 can comprise conventional devices (such as a system of rollers that extend at least as wide as the transverse width of the partially separated web) for guiding and transporting full width webs, thereby avoiding handling and tensioning of each of the web portions 26 separately and the possible resulting variations in guiding and tensioning that can lead to wandering and other problems. For example, as shown in FIG. 1, the connected web portions 26 can be routed in a conventional manner between guiding rollers 50, 52, 54, and 56 and a tensioning roller 58, with the connected web portions 26 passing in one radial direction (for example, in a counter-clockwise direction) around the guiding roller 54 and in the opposite radial direction (for example, in a clockwise direction) around another guiding roller 56. The tensioning roller 58 is preferably adjustable in that a load L (FIG. 1) that is applied to the tensioning roller 58 can be varied to increase or decrease the tension applied to the partially separated web within the guiding and transporting system 16. Such tensioning rollers and adjustment mechanisms are conventionally known, and may include pneumatic, hydraulic or electrical systems or other mechanical systems such as using springs. In any case, the tensioning roller 58 can be located in between the guiding rollers 54 and 56 to suitably tension the connected web portions 26 at that point. Each and/or any of the rollers 50, 52, 54, 56, and 58 may be driven or may be idle (that is, rotate in response to web movement).

Moreover, other conversions or web processes (especially processes that operate on full width webs) can be done during the period when web 10 is being guided and transported between the first and second separation stages. For example, the web could be coated, features could be formed in the web portions 26, or the connected web portions 26 could be cooled or heated. At a minimum, whatever guiding and transporting necessary to physically get the connected web portions 26 to the use supply form conversion station 20 can be done during the period when web 10 is being guided and transported between the first and second separation stages.

Figure 3:
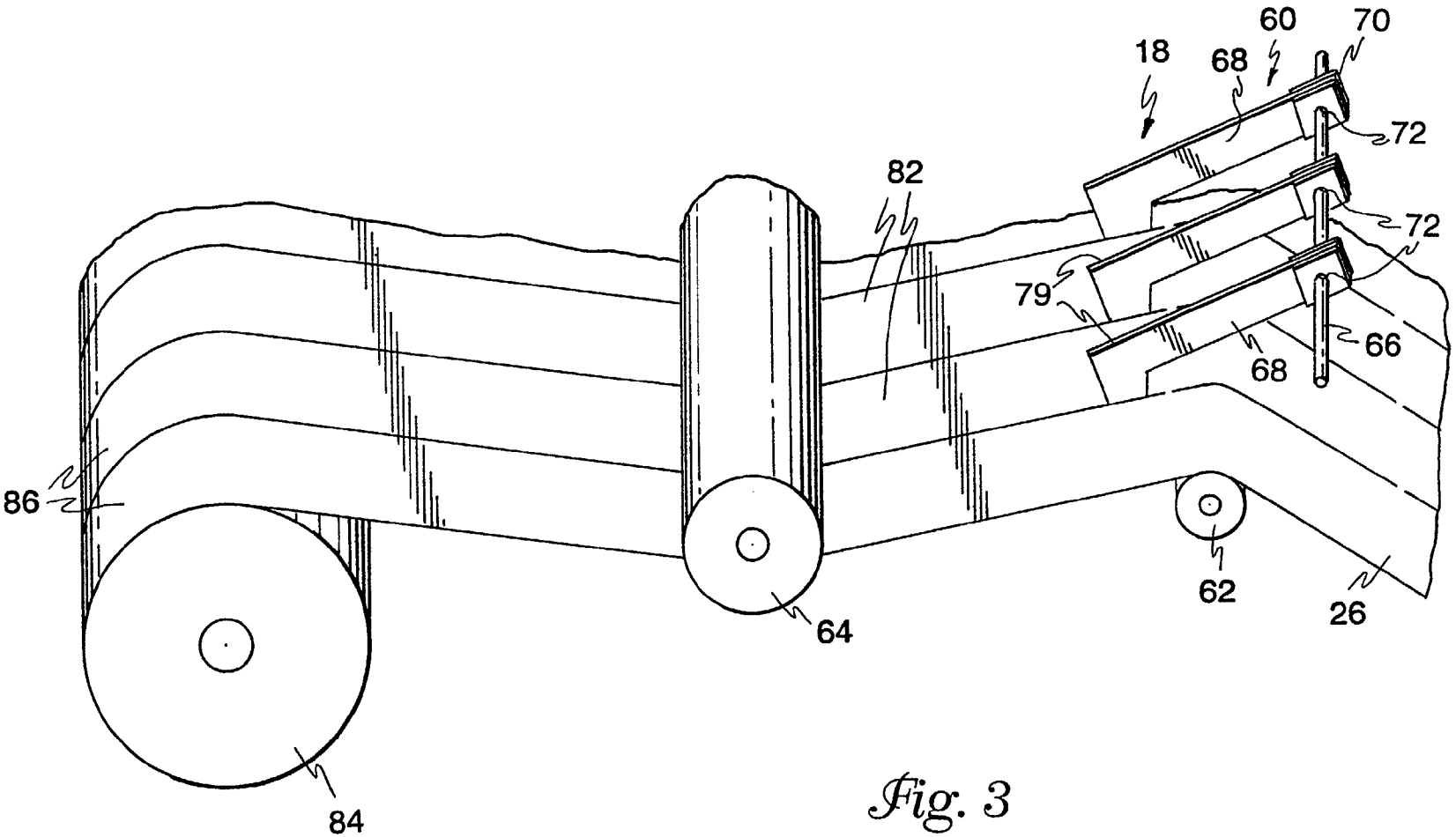
FIG. 3 is a perspective view of a plurality of breaking tools, usable as a breaking mechanism in the apparatus of FIG. 1, positioned at transverse points across a moving, substantially divided web near the use supply form conversion station at which the rolls are created.
Figure 6:
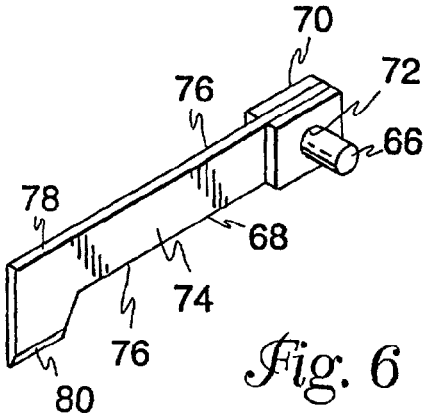
FIG. 6 is a perspective view of a breaking tool shown in FIG. 3.

As shown in FIG. 3, a specific embodiment of the second stage separation mechanism 18 comprises at least one breaking mechanism 60. The breaking mechanism is preferably located intermediate rollers 62 and 64 so as to act on the partially separated web within the span of the partially separated web between them. The illustrated breaking mechanism 60 includes a shaft 66 on which a plurality of breaking tools 68 are mounted at transverse points across web 10. Preferably, the breaking tools 68 are rotationally and axially fixed in position along the shaft 66. As shown in more detail in FIG. 6, the breaking tools 68 are shaped to include a mounting region 70 having a hole 72 through which the shaft 66 passes. An intermediate region 74, having lateral edges 76, extends from the mounting region 70 and terminates at a breaking region 78. The breaking region 78 has a beveled edge 80 projecting beyond one of the lateral edges 76 of the intermediate region 74. As shown in FIG. 6, the breaking tools 68 are arranged axially along the shaft 66 so that there is one breaking tool 68 aligned with each separation line 40 connecting web portions 26 that is to be broken (as described in greater detail below, it may be desirable that not all separation lines 40 are broken prior to converting the web 10 into use supply forms). The breaking tools 68 are preferably adjustably fixed along the shaft 66 so that they can be accurately positioned to align with the separation lines 40 and to accommodate different web slitting applications. The breaking tools 68 are preferably disposed within the apparatus between the rollers 62 and 64 and adjacent to one side of the connected web portions 26 so that the shaft 66 can be rotated to have at least the beveled edges 80 of the breaking tools 68 cross the plane of the connected web portions 26 as the partially separated web is moved in the machine direction past the breaking tools 68 in order to break the connections 38 of the separation lines 40 to form discrete web portions 82. The shaft 66 can be rotated and locked or otherwise held in an operative position by any conventional means such as by a pneumatic cylinder controlled by a system (not shown) in accordance with known techniques.

Figure 7:
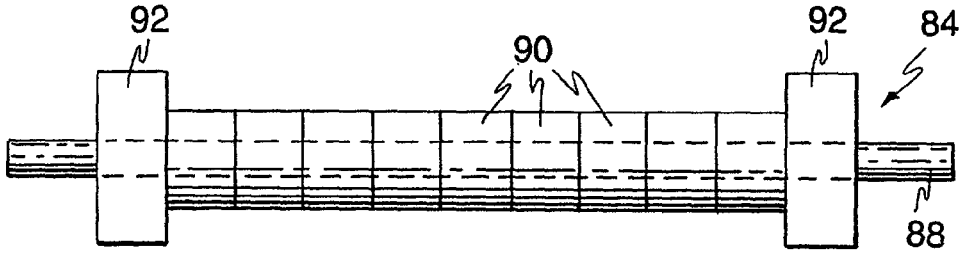
FIG. 7 is a plan view of a roll winding device for use in the apparatus shown in FIG. 1.

Other methods to accomplish the complete separation may not require that a device cross the plane of the connected web portions 26 in order to separate the web portions 26 to form discrete web portions 82. Other examples of methods and techniques for partially and/or complete separating include, without limitation, burning, such as by hot wires or lasers, water jets. air blasting, ultrasonic slitting, razor slitting, rotary razor slitting, or the like. Of these, many would not require any device to cross the plane of the connected web portions 26. FIGS. 3 and 7 show a specific embodiment of a use form conversion station 20. A winding roll 84 is preferably located immediately downstream (that is, as close as can be) from the second stage separation mechanism 18 so as to convert the discrete web portions 82 into use supply forms 86 so that the discrete web portion guiding and transporting is minimized. As shown in FIG. 7, the winding roller 84 includes a winding shaft 88 about which several cores 90 (for example, cardboard rolls) are axially arranged side-by-side. Each of the web portions 82 are wound about one of the cores 90 and, therefore, each core 90 should be as wide as the particular web portion 82 to be wound about that particular core 90. Conventional end blocks 92 are located at both ends of the winding shaft 88 to hold the cores 90 in place between the end blocks 92. Preferably, the winding roll 84 is of a conventional expanding core type, wherein each core 90 is individually supported on an expandable shaft which is driven to frictionally drive the cores 90 from within (to allow independent core slippage). Alternatively, all the cores 90 may be locked in place (as shown in FIG. 7) by the end blocks 92 to rotate together about the shaft 88, as driven by rotation of the shaft 88 through the end blocks 92. In either case, any conventional or developed winding technology is contemplated.

A configuration of slits 37 and connections 38 that form a separation line 40 can be characterized by the ratio of the length of the slits 37 over the length of the connections 38. This slit-to-connection ratio of a separation line 40 is an indication of the ability of the connections 38 to hold the two connected web portions 26 together during handling and transporting, referred to herein as the "lateral strength" of the separation line 40. The slit-to-connection ratio is inversely related to the lateral strength of a separation line 40. The lower the slit-to-connection ratio is (all other things being equal), the higher the lateral strength will be and the harder it will be (that is, a greater force will be needed) to break the connections 38 and separate the web portions 26 to form the discrete web portions 82; conversely, the higher the slit-to-connection ratio is, the lower the lateral strength will be and the easier it will be to break the connections 38 and separate the web portions 26. Also, if a relatively thinner and/or weaker web material is used, the slit-to-connection ratio may be lower if it is desirable to maintain the same level of lateral strength that would result from using a thicker and/or stronger web material. Thus, the slit-to-connection ratio and the strength and thickness of web material can be optimized for particular applications. As examples, a web 10 comprising polypropylene and having a mean thickness of about 100 microns can have separation lines 40 comprising connections 38 that each take up only about 0.7 mm out of each 240 mm segment of a separation line 40 to provide a slit-to-connection ratio of about 343:1. Where one connection 38 takes up about 0.9 mm out of each 240 mm segment, the slit-to-connection ratio would be about 480:1. With four connections 38 of about 0.9 mm for each 240 mm segment, a slit-to-connection ratio of about 67:1 would be provided. Thus, a preferred range for the slit-to-connection ratio for such a material web is between about 50:1 and 500:1. With other web materials, the ratios can be completely different. For a stronger web, the ratio may be much higher. With very weak webs (maybe a paper or nonwoven) a much smaller ratio may be desired, such as 1:1 or lower (i.e. with connections that are of greater length than the slits).

At the second separation stage 18, the web portions 26 are completely separated into discrete web portions 82 by breaking the connections 38 so that the discrete web portions 82 can be converted into a plurality of use supply forms 86. The connections 38 can be broken in a number of ways including cutting, bursting, severing, tearing, burning and the like. Preferably, the connections 38 are broken by the breaking tool 68 as shown in FIG. 6 and described above. A use supply form 86 is a configuration of web material in a form that can supply web material for some particular use. Examples of use supply forms 86 include rolls of web material that are formed by winding a web portion 82 about a core 90 and stacks of web portions 82 that are formed by either folding a web portion 82 (for example, in an accordion or fan-fold manner) or cutting a web portion 82 transversely to form cut sheets that are piled on top of one another.

In some cases, it may be desirable that one or more of the separation lines 40 not be completely separated at the second separation stage. That is, the use supply forms 86 may include lines of weakening 40 that are not separated, if ever, until after the web portions 26 have been converted into use supply forms 86 (in other words, the connections 38 of these separation lines are broken, if ever, at the point of use). For example, the web 10 can be slit so as to have primary separation lines that define web portions. One or more web portion can have secondary separation lines, which can have slit and connection configurations that differ from, or are the same as, the primary separation lines (for example, the secondary separation lines can be formed so as to have a lower slit-to-connection ratio than the primary separation lines) that subdivide the web portion into two or more web subportions separated by at least one secondary separation line. During the second separation stage, it may be desirable to only break the connections in the primary separation lines in order to completely separate the web portions while the web subportions remain connected to one another. The web portions, which have web subportions connected by secondary separation lines, can then be processed into use supply forms. Thus, the use supply form will supply a web portion having one or more secondary separation lines that can be separated by the user of the web portion so as to form web subportions.

Generally, any material that can be formed into a web 10 having separation lines 40 that are sufficiently strong to allow the connected web portions 26 to be processed as a full width web can be used with the present invention. Such materials include paper (for example, toilet paper, computer paper, paper towels, etc.), plastic-backed and paper-backed tape (for example, adhesive tape, magnetic tape, etc.), nonwovens, elastics, and the like. The webs 10 can be formed as single webs (for example, films), structured webs (for example, webs with structured features), multilayer laminates, or coated webs (for example, adhesive coated webs for making adhesive tape). Webs that have one or both of its major surfaces structured, for example a web of hook material usable as part of hook and loop connection system, provide less contact with at least some of the web handling and guiding system. Thus, such webs may have a greater tendency to wander side-to-side during the handling and guiding of such material. This may also be true of other webs having one or both major surfaces thereof treated or comprising material that either reduces the contact between the guide rollers and the web or changes its coefficient of friction. With such webs, the present invention is particularly advantageous because it allows the partially separated web to be handled as a full width web. Guiding and handling of the many smaller separated web portions is avoided.

Figure 4:
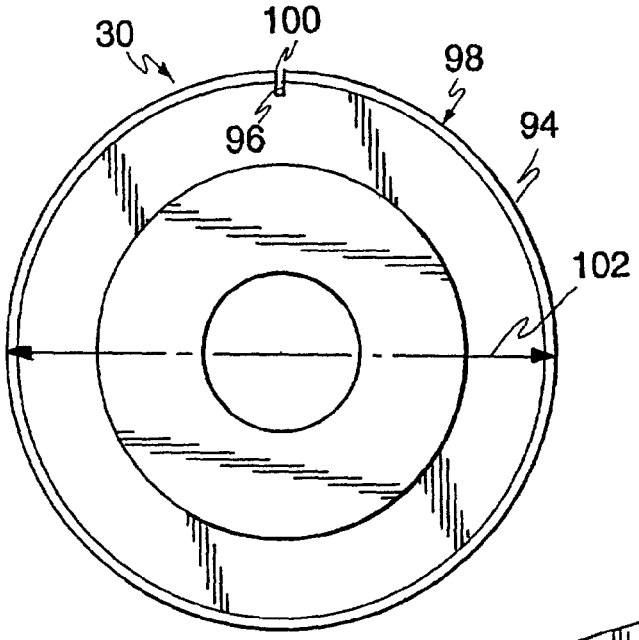
FIG. 4 is a side view of a slitting wheel of the slitting mechanism shown in FIG. 2.
Figure 5:
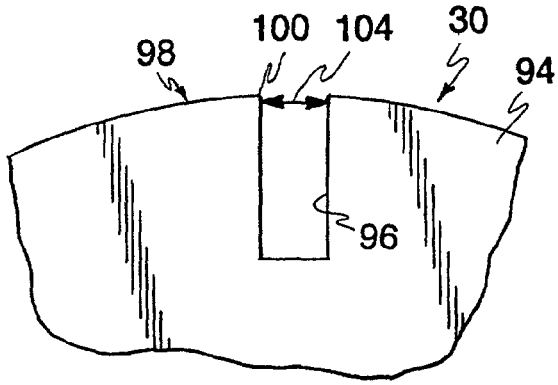
FIG. 5 is an enlarged side view of a portion of the slitting wheel shown in FIG. 4.

As shown in FIGS. 4–5, each slitting wheel 30 has a beveled, peripheral cutting edge 94 in which one or more notches 96 are formed at angularly spaced intervals so as to define cutting and non-cutting portions 98 and 100 of the cutting edge 94. As described above, the cutting portions 98 of the cutting edge 94 cuts the perforations of the separation lines 40 into the web 10 when the cutting portion 98 of cutting edge 96 is rotated over the web 10, and the non-cutting portions 100 (that is, the notches 96) do not cut the web 10 (thereby forming the connections 30 of the separation line 40) when the non-cutting portions 100 rotate over the web 10. Therefore, as each slitting wheel 30 is rotated over the moving web 10, separation lines 40, comprising a series of slits 37 separated by a series of connections 38, are formed in the web 10. As shown in FIG. 2, the separation lines 40 formed by the slitting wheels 30 define connected web portions 26 in the web 10 wherein the web portions 26 are substantially split but are connected.

As is known in the art, preferably the cutting edge 94 is softer than the outer surface 34 of the back-pressure roll 36 so that grooves are not cut into the outer surface 34. Also, the slitting wheels 30 preferably have relatively blunt cutting edges 94 as opposed to sharp keen cutting edges to further avoid cutting grooves in the outer surface 34 of the back-pressure roll 36. The slitting wheels 30 can be made of any relatively hard material out of which a suitable beveled cutting edge 94 can be formed. Preferably, the slitting wheel 30 is formed of steel or steel alloy. Moreover, the slitting wheels 30 have a diameter 102 that is typically between 70 and 80 mm. Cutting wheels in general are commercially available, such as for example from Alcon Tool Company of Akron, Ohio. Such commercial cutting wheels can be modified to form the connected zones in accordance with the present invention as needed by providing notches 96 by any conventional manner. The cutting wheels 42 are substantially the same as the slitting wheels 30 except that the cutting wheels 42 do not have notches 95 formed in their cutting edges 94.

The slit-to-connection ratio of the separation line 40 formed by any given slitting wheel 30 is determined by the number, the spacing, and the radial width 104 (shown in FIG. 5) of the notches 96. These parameters can be varied so as to form separation lines 40 in the web 10 having appropriate slit-to-connection ratios for a given application. The slitting wheel 30 can be formed with only one notch 96 in the cutting edge 94 (as is shown in FIGS. 4–5) so that only one connection 38 is formed in the separation line 40 per rotation of the slitting wheel 30. Alternatively, the slitting wheel 30 can be formed with two or more notches 96 so that the two or more connections 38 are formed in the separation line 40 per rotation of the slitting wheel 30. Also, the various slitting wheels 30 arranged on the slitting shaft 32 can vary from one another; for example, the slitting mechanism 28 can include slitting wheels 30 having one notch 96 that are used for slitting primary separation lines and slitting wheels 30 having four notches that are used for slitting secondary separation lines. A slitting wheel 30 suitable for perforating a web 10 comprising a 100 micrometer base film of polypropylene can have a single 0.77 millimeter notch 96 provided to a slitting wheel having a circumference, when new, of about 240 mm. This would provide a separation line 40 as noted above with a slit-to-connection ratio of about 343:1. Any ratio can be accomplished as a comparison of wheel circumference to the width and number or notches for that given circumference.

Each and any of the rollers described above may be driven or may be idle (that is, rotated in response to web movement) depending largely on the material of the web 10, although some means must be provided for continuously driving web 10 in the machine direction through the apparatus. Typically, the back-pressure roller 36 and the winding shaft 88 are driven in order to move web 10 in the machine direction.

Figure 8:
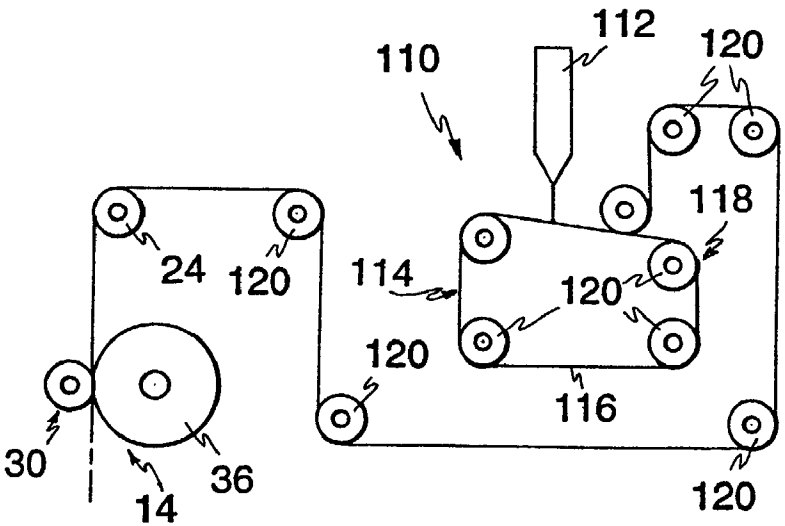
FIG. 8 is a schematic illustration of an extruding apparatus that can be substituted for the web supply of the apparatus shown in FIG. 1.

Alternatively, a conventional extruding apparatus 110 (shown in FIG. 8) or other means for forming the web 10 can replace the supply roll 22 for supplying web 10 to the apparatus of the present invention. The extruding apparatus 110 has an extruder 112 from which web material is extruded onto a moving, looped belt 114. The moving belt 114 may simply support the film while it cools sufficiently to set up or can have a structured surface 116 for forming desired structural features in the web 10. The formed web 10 can be separated from the moving belt 114 about a roller 118, and rollers 120 can then appropriately and conventionally guide and transport the web 10 so that the web 10 is fed to the rest of the apparatus shown in FIG. 1 for slitting and converting into use supply forms 86 as described above.

The extruding apparatus 110 can also include means for further processing the web 10. For example, the extruding apparatus 110 can include heated rollers (not shown) with structured outer surfaces that can be used for heating the web 10 to form additional features on one or more surfaces of the web 10.

As alternatives to separation lines 40 that are formed by a series of slits 37 and connections 38 described above, other lines of weakness that substantially separate web portions 26 while also connecting the web portions 26 are contemplated. For example, lines of weakness can be formed by creating lines of partial thickness in web 10 that do not penetrate the web 10. Reducing the thickness of the web material weakens the web material along the line and is characterized as substantially cutting the web 10. The web portions defined by the partial thickness line, however, are connected together by the remaining, relatively thin portion of web material within the line. Such a partial thickness line of weakening could be created, for example, by using a conventional cutting wheel 42 as described above with reduced contact pressure so that the cutting wheel 42 forms (or cuts) a crease or groove in the web 10 without completely cutting or penetrating the web 10. Other types of grooving, embossing or calendaring techniques could be used.

Although the present invention has been described with reference to preferred embodiments, workers skilled in the art will recognize that changes may be made in form and detail without departing from the spirit and scope of the invention.

What is claimed is:

1. A web converting manufacturing machine comprising:

a continuous web source having a continuous web which web has a transverse width and an indefinite length;

transport and guiding means for continuously moving the continuous web in a single plane from a source of the continuous web in a machine direction to a use form conversion station;

a first separation stage located downstream from the source and comprising a first separation device comprising a slitting device that partially separates the web along a continuous straight line the machine direction while in the single plane at a point along its transverse direction to substantially separating the web along a separation line so as to make a partially separated web having defined connected web portions along the separation lines, providing a slit to connection ratio for the web of greater than 1 the partially separated web portion extend along the separation line with the connected web portions extending in the machine direction of the partially separated web;

a second separation stage located downstream from the first separation stage and comprising a second separation device which device rotates about a fixed axis so that in one position it continuously breaks the connected web portions along the separation lines in the machine direction so as to separate the web into discrete web portions that extend in the machine direction while in the single plane and which second separation device can rotate to a second position such that second separation stage, when the second separation device is in the second position does not break the connected web portion; and the use form conversion station for converting the discrete web portions in the single plane into a plurality of use supply forms.

2. The machine of claim 1, wherein the first separation stage includes plural first separation devices positioned along the transverse width of the web that partially separate the web at plural points along the transverse width of the web for defining the partially separated web with more than two connected web portions.

3. The machine of claim 2, wherein each first separation device includes a slitting wheel having a cutting edge that forms lines of weakening that extend in the machine direction of the web along the partially separated web for defining the connected web portions.

4. The machine of claim 3, wherein the second stage includes plural second separation devices positioned along the transverse width of the web in order to separated the connected web portions along the lines of weakening.

5. The machine of claim 4, wherein each of the cutting edge of each slitting wheel includes at least one cutting portion for cutting a series of slits in the line of weakening and at least one non-cutting portion for forming connected zones in the lines of weakening between the slits.

6. The machine of claim 5, wherein the non-cutting portion of each slitting wheel includes at least one notch for creating the connected portion of the web.

7. The machine of claim 5, wherein the cutting portion and the non-cutting portion of each slitting wheel is such that each line of weakening has a slit-to-connection zone ratio in the range of 50:1 to about 500:1.

8. The machine of claim 2, wherein each first separation device includes a cutting portion for forming the lines of weakening by making a partial thickness line.

9. The machine of claim 4, wherein the transport means includes a system of rollers for guiding and transporting the partially separated web that extend at least as wide as the transverse width of the partially separated web for handling the partially separated web as a full width web in transporting the web from the first separation stage to the second separation stage.

10. The machine of claim 5, wherein each second separation device includes a breaking tool that is positioned so that a portion thereof extends through the thickness of the partially separated web for breaking the connection zones in the lines of weakening and making the discrete web portions as the partially separated web is moved in the machine direction.

11. The machine of claim 10, wherein the use conversion station includes a roll wind-up station for converting the discrete web portions into rolls of the discrete web portions as the use supply forms.

12. The machine of claim 11, wherein the roll wind-up station comprises a shaft supporting plural roll cores that are aligned substantially edge-to-edge along the shaft, and each of the roll cores is wound with a discrete web portion by rotating the shaft.

13. The machine of claim 12, wherein the roll wind-up station is located downstream but near the second separation station so that the discrete web portions run downstream from the second separation station directly to the roll wind-up station.

14. The machine of claim 1, wherein the first separation stage includes plural primary slitting wheels positioned along the transverse width of the web that partially separate the web for forming plural primary lines of weakening and at least one secondary slitting wheel positioned in between two primary slitting wheels along the transverse width of the web that partially separate the web for forming at least one secondary line of weakening that extends in the machine direction of the web along the partially separated web for defining the connected web portions, and wherein the second separation devices are positioned along the transverse width of the web to separate the connected web portions along the primary lines of weakening so that at least one use supply form is converted from a discrete web portion that has a secondary line of weakening extending along that discrete web portion.

15. The machine of claim 14, wherein each of the primary slitting wheels includes at least one primary cutting portion and at least one primary non-cutting portion and the secondary slitting wheel includes at least one secondary cutting portion and at least one secondary non-cutting portion, wherein the primary and secondary lines of weakening are formed by a series of slits formed by the primary and secondary cutting portions respectively and connections formed by the primary and secondary non-cutting portions respectively in between the slits.

16. The machine of claim 15, wherein the primary cutting portion and the primary non-cutting portion of each primary slitting wheel and the secondary cutting portion and the secondary non-cutting portion of each secondary slitting wheel is such that a slit-to-connection zone ratio of the primary line of weakening is different from a slit-to-connection zone ratio of the secondary line of weakening.

17. The machine of claim 16, wherein the use conversion station includes a roll wind-up station for converting the discrete web portions, including a discrete web portion that has a secondary line of weakening, into rolls as the use supply forms.

* * * * *